US007018069B1

(12) United States Patent
Barton

(10) Patent No.: US 7,018,069 B1
(45) Date of Patent: Mar. 28, 2006

(54) MULTI-PURPOSE LIGHT

(76) Inventor: James C. Barton, 1658 Smyrna Rd., Keatchie, LA (US) 71046

( * ) Notice: Subject to any disclaimer, the term of this patent is extended or adjusted under 35 U.S.C. 154(b) by 90 days.

(21) Appl. No.: 10/874,638

(22) Filed: Jun. 23, 2004

(51) Int. Cl.
*F21W 131/30* (2006.01)

(52) U.S. Cl. ..... 362/255; 232/17

(58) Field of Classification Search ..... 362/154, 362/155, 156, 133; 232/17
See application file for complete search history.

(56) References Cited

U.S. PATENT DOCUMENTS

| | | | | |
|---|---|---|---|---|
| 4,648,012 A | | 3/1987 | Pittman, II | 362/155 |
| 4,755,915 A | | 7/1988 | Rogers | 362/155 |
| 5,032,957 A | * | 7/1991 | Canfield | 362/133 |
| 5,558,429 A | * | 9/1996 | Cain | 362/155 |
| 5,975,713 A | | 11/1999 | Brothers | 362/155 |
| 6,033,084 A | | 3/2000 | Burke | 362/155 |
| 6,102,548 A | | 8/2000 | Mantle et al. | 362/155 |
| 6,601,969 B1 | | 8/2003 | Barton | 362/155 |
| 6,666,372 B1 | * | 12/2003 | Nagel | 232/45 |
| 6,672,736 B1 | * | 1/2004 | Waldman | 365/155 |
| 2002/0145868 A1 | | 10/2002 | Barton | |

* cited by examiner

*Primary Examiner*—Laura K. Tso
(74) *Attorney, Agent, or Firm*—R. Keith Harrison

(57) ABSTRACT

A multi-purpose light is disclosed. The multi-purpose light includes a housing, an illumination mechanism provided in the housing for illuminating the mailbox interior and a switch provided on the housing for reversibly activating the illumination mechanism. Aa pivot contact having a generally cylindrical pivot portion is rotatably mounted in the housing and engaged by the switch. A contact extension extends from the pivot portion. The switch is moveable between a first position wherein the contact extension disengages the illumination mechanism and the illumination mechanism is extinguished, and a second position wherein the pivot contact rotates in the housing and the contact extension engages the illumination mechanism to activate the illumination mechanism. An activation clip embodiment of the multi-purpose light is also disclosed.

20 Claims, 4 Drawing Sheets

MULTI-PURPOSE LIGHT

FIELD OF THE INVENTION

The present invention relates to portable lights and more particularly, to a multi-purpose light which can be quickly and easily removably installed on a mailbox, purse or other enclosure to facilitate automatically or selectively illuminating and viewing the interior of the enclosure when the door of the enclosure is opened.

BACKGROUND OF THE INVENTION

Womens' purses are typically provided with a spring-loaded jaw which is manually pried open to open the purse and which snaps shut to close the purse when released. Even when opened, however, the interior of the purse is typically dark. This renders it difficult to locate objects such as makeup, lipstick and other items, especially when the purse is opened inside poorly-illuminated buildings.

While mail is typically delivered during daylight hours in the United States, persons may retrieve mail from their mailboxes in the late evening, during hours of darkness. Consequently, it is frequently necessary to hand-feel the dark mailbox interior to ensure that all the delivered mail has been retrieved from the mailbox. This, however, has limitations since important mail-delivered notices such as those appearing on flat postcards or sheets of paper can evade detection by feel and thus, inadvertently remain in the mailbox. Moreover, many persons are reluctant to thrust their hands into dark mailboxes for fear of striking sharp objects or unwittingly encountering spiders or insects.

Accordingly, a multi-purpose light is needed which can be removably attached to the interior of a purse, mailbox or other enclosure to facilitate selectively or automatically lighting the enclosure interior when opened.

SUMMARY OF THE INVENTION

The present invention is generally directed to a multi-purpose light which is useful for illuminating the interior of a mailbox, purse or other enclosure, for example. In one embodiment, the multi-purpose light is selectively activated and includes a housing, an illumination mechanism provided in the housing for illuminating the mailbox interior and a switch provided on the housing for reversibly activating the illumination mechanism. A pivot contact having a generally cylindrical pivot portion is rotatably mounted in the housing and engaged by the switch. A contact extension extends from the pivot portion. The switch is moveable between a first position wherein the contact extension disengages the illumination mechanism and the illumination mechanism is extinguished, and a second position wherein the pivot contact rotates in the housing and the contact extension engages the illumination mechanism to activate the illumination mechanism and illuminate the interior of the enclosure. The invention further includes an activation clip embodiment of the multi-purpose light which is automatically activated upon opening of the enclosure.

BRIEF DESCRIPTION OF THE DRAWINGS

The invention will be better understood by reference to the accompanying drawings, wherein.

DETAILED DESCRIPTION OF THE INVENTION

Figure 1:
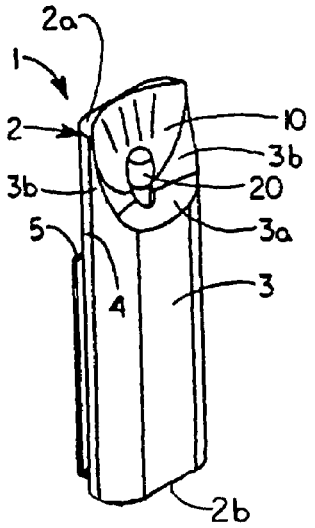
FIG. 1 is a front perspective view of a switch-operated multi-purpose light of the present invention, with the multi-purpose light energized.
Figure 12:
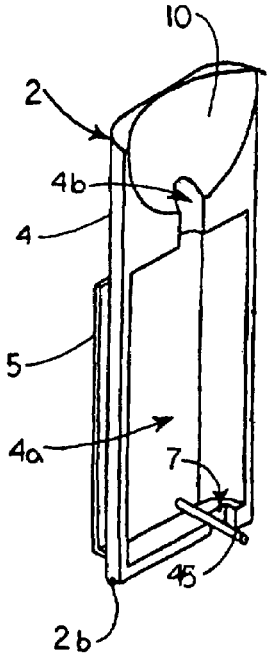
FIG. 12 is an interior perspective view of a right housing panel element of the multi-purpose light.

Referring initially to FIGS. 1–6 and 12 of the drawings, a switch-operated embodiment of the multi-purpose light of the present invention is generally illustrated by reference numeral 1. The multi-purpose light 1 includes an elongated, generally rectangular, typically plastic housing 2, having a front end 2*a* and a rear end 2*b* and constructed of a front housing panel 3 which engages a complementary rear housing panel 4 typically in a snap-fit. As illustrated in FIG. 12, the interior of the rear housing panel 4 has a rectangular battery compartment 4*a* for containing a battery assembly 19, as will be hereinafter described. A neck seat 4*b* communicates with the battery compartment 4*a* in the right housing panel 4, and a generally beveled, concave or dish-shaped reflection surface 10 is shaped in the rear housing panel 4 at the front end 2*a* of the housing 2, the purpose of which neck seat 4*b* and reflection surface 10 will be hereinafter described. The front housing panel 3, similar in shape to the rear housing panel 4 and having an interior battery compartment (not illustrated) complementary in size and shape to the battery compartment 4*a* of the rear housing panel 4, is characterized by a panel bevel 3*a* and a pair of spaced-apart, tapered panel extensions 3*b* that contribute to the concavity of the reflection surface 10 of the rear housing panel 4 when the front housing panel 3 is attached to the rear housing panel 4, as illustrated in FIG. 1. In a preferred embodiment, the reflective surface 10 of the rear housing panel 4 and the panel bevel 3*a* and panel extensions 3*b* of the front housing panel 3 are coated with a white or silver reflective paint or other light-reflective medium, according to the knowledge of those skilled in the art. A neck notch (not shown) is shaped in the front housing panel 3, between the panel extensions 3*b* for purposes which will be hereinafter described.

Figure 2:
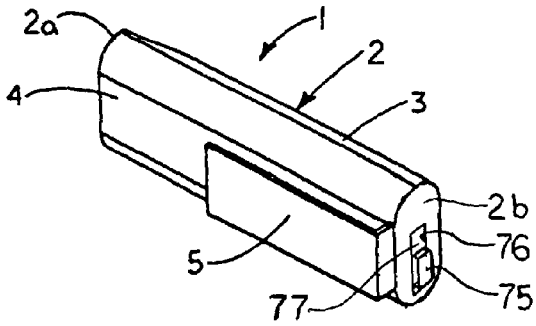
FIG. 2 is a rear perspective view of the multi-purpose light shown in FIG. 1.
Figure 11:
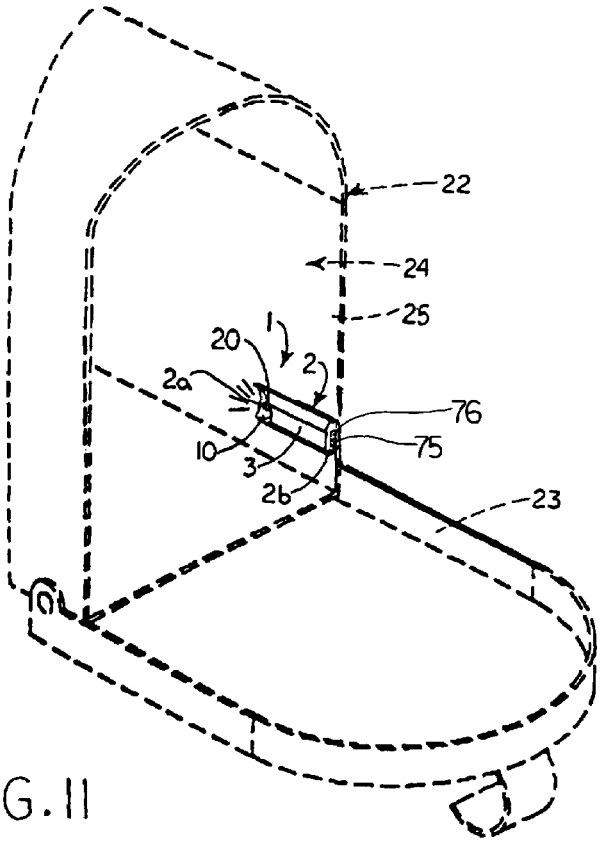
FIG. 11 is a perspective view of a preferred embodiment of the switch-operated embodiment of the multi-purpose light of the present invention, removably attached to a post-type mailbox (in phantom) and selectively illuminating the mailbox interior after opening of the mailbox door.

As illustrated in FIG. 2, a flexible attachment clip 5 is typically provided on the outside surface of the rear housing panel 4 for removably attaching the housing 2 to the right side wall 25 of the mailbox 22 in an illustrative application of the multi-purpose light 1, as illustrated in FIG. 11 and hereinafter described. The attachment clip 5 is typically generally flush with the flat rear end 2*b* of the housing 2, and is disposed on the housing 2 opposite the reflection surface 10, as illustrated in FIG. 1. As illustrated in FIG. 12, a pivot pin 45 extends from the rear housing panel 4, into the battery compartment 4*a* and inserts in a pivot pin receptacle (not illustrated), provided in the front housing panel 3, for purposes hereinafter described.

Figure 3:
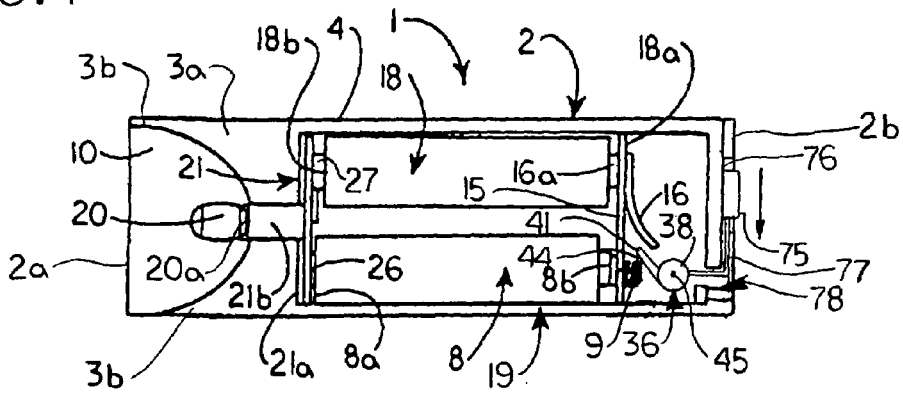
FIG. 3 is an interior view of the right housing panel element of the switch-operated multi-purpose light, with a preferred battery assembly for energizing the light bulb element, and the switch element shown breaking electrical contact between the batteries of the battery assembly to extinguish the light bulb.
Figure 4:
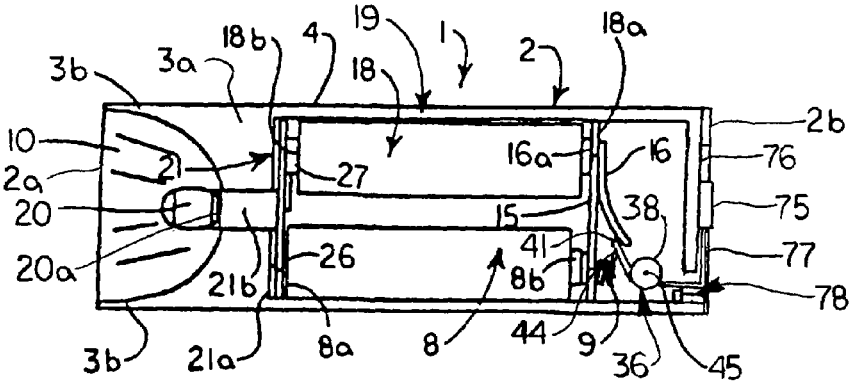
FIG. 4 is an interior view of the right housing panel element of the multi-purpose light, with the switch element of the light shown establishing electrical contact between the batteries to energize the light bulb.

As illustrated in FIGS. 3 and 4, the battery assembly 19 is contained in the assembled housing 2 as hereinafter further described, and includes a first battery 8, having a negative terminal 8*a* and a positive terminal 8*b*; and a second battery 18, having a negative terminal 18*a* and a positive terminal 18*b*. A typically plastic bulb harness 21 of the battery assembly 19 includes an elongated, flat harness base 21*a* and a perpendicularly-extending harness neck 21*b*, which harness base 21*a* is fitted on the bottom end thereof with a metal negative contact 26 that engages the negative terminal 8*a* of the first battery 8. The harness base 21*a* is further provided with a metal positive contact 27 which engages the positive terminal 18*b* of the second battery 18. The threaded bulb base 20*a* of a light bulb 20 is threaded into the harness neck 21*b* of the bulb harness 21. The negative contact 26 and positive contact 27 each extends from the bottom surface of the harness base 21*a* and terminates inside the harness neck 21*b* of the bulb harness 21, where the negative contact 26 establishes electrical contact between the negative terminal 8*a* of the first battery 8 and the bulb base 20*a* of the light bulb 20, and the positive contact 27 establishes electrical contact between the positive terminal 18*b* of the second battery 18 and the bulb base 20*a* of the light bulb 20.

As further illustrated in FIGS. 3 and 4, an elongated, plastic spring mount plate 15 of the battery assembly 19 is fitted with a metal contact spring 9 which extends through a spring opening (not illustrated) provided in the spring mount plate 15 and is disposed in electrical contact with the positive terminal 8*b* of the first battery 8. The cylindrical contact base 16*a* of a metal clip contact 16 extends through an opening (not illustrated) provided in the spring mount plate 15 and is disposed in electrical contact with the negative terminal 18*a* of the second battery 18. The battery assembly 19 is seated in the battery compartment 4*a* (FIG. 12) of the rear housing panel 4 and in the complementary battery compartment (not illustrated), provided in the front housing panel 3, with the harness neck 21*b* of the bulb harness 21 extending through the neck seat 4*b* of the rear housing panel 4 and the complementary neck notch (not illustrated) of the front housing panel 3. Accordingly, as illustrated in FIG. 1, the light bulb 20 is disposed adjacent to the reflection surface 10 of the rear housing panel 4 and the panel bevel 3*a* and panel extensions 3*b* of the front housing panel 3.

As illustrated in FIGS. 2–4, a switch slot 76 is provided in the rear end 2*b* of the housing 2 of the multi-purpose light 1, and a switch 75 is slidably mounted in the switch slot 76. A switch connector 77, which is preferably a flexible rubber or plastic material, is attached to the switch 75 and extends through a connector opening 78 provided in the rear end 2*b* of the housing 2, as illustrated in FIGS. 3 and 4. The extending end of the switch connector 77 is attached to a pivot contact 36 which is pivotally mounted in the housing 2 as hereinafter further described.

Figure 5:
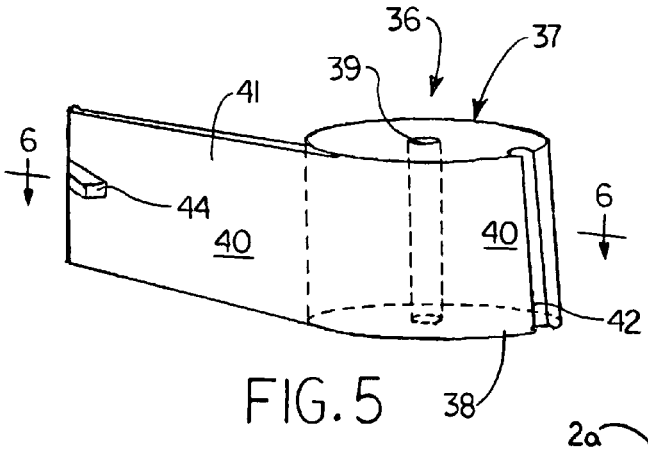
FIG. 5 is a perspective view of a pivot contact element of the multi-purpose light for reversibly establishing electrical contact between the batteries of the battery assembly.
Figure 6:
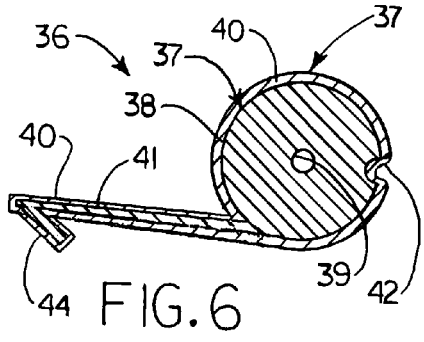
FIG. 6 is a longitudinal sectional view, taken along section lines 6—6 in FIG. 5, of the pivot contact element of the multi-purpose light.
Figure 8:
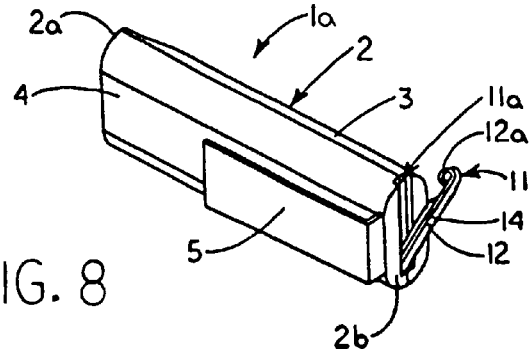
FIG. 8 is a rear perspective view of the multi-purpose light illustrated in FIG. 7.
Figure 7:
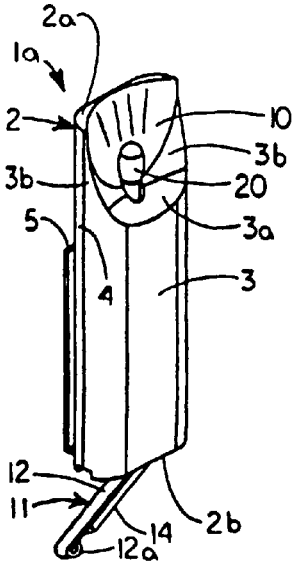
FIG. 7 is a front perspective view of an activation clip-operated multi-purpose light of the present invention, with the multi-purpose light energized.

As illustrated in FIGS. 5 and 6, the pivot contact 36 includes a pivot contact body 37 which is typically plastic. The pivot contact body 37 includes a generally cylindrical pivot portion 38 and an elongated contact extension 41 which extends from the pivot portion 38. A pivot pin opening 39 extends through the pivot portion 38, and a spring attachment tab 44 typically extends from the contact extension 41. An electrically-conductive coating 40, which may be copper or aluminum, for example, is provided on the pivot portion 38, the contact extension 41 and the spring attachment tab 44 of the pivot contact body 37. An elongated attachment slot 42, the purpose of which will be hereinafter described, is provided in the pivot portion 38 of the pivot contact body 37.

As illustrated in FIGS. 3 and 4, when the front housing panel 3 is mounted to the rear housing panel 4, the pivot contact 36 is pivotally mounted on the pivot pin 45, which extends from the rear housing panel 4 (FIG. 12) and through the pivot pin opening 39 (FIG. 5) of the pivot portion 38. The contact spring 9 is attached to the spring attachment tab 44 of the pivot contact 36, and the switch connector 77 of the switch 75 is inserted in the attachment slot 42 and secured therein using techniques known to those skilled in the art. As shown in FIG. 3, the switch 75 is normally positioned in the switch slot 76 to orient the pivot contact 36 in such a position that the contact extension 41 does not contact the clip contact 16. Upon sliding of the switch 75 in the direction indicated by the arrow if FIG. 3, by actuation of the switch connector 77, the contact portion 38 pivots in the clockwise direction on the pivot pin 45 such that the contact extension 41 contacts the clip contact 16, thus establishing electrical communication between the first battery 8 and second battery 18 through the contact spring 9 and clip contact 16, thereby illuminating the light bulb 20 of the multi-purpose light 1, as illustrated in FIG. 4. Upon sliding of the switch 75 in the opposite direction, by actuation of the switch connector 77 the contact portion 38 pivots in the counter-clockwise direction on the pivot pin 45 such that the contact extension 41 is moved out of contact with the clip contact 16, thereby extinguishing the light bulb 20, as illustrated in FIG. 3.

Referring next to FIGS. 3, 4 and 11 of the drawings, in one possible application the multi-purpose light 1 is attached to the right side wall 25 of a post-type mailbox 22 with the housing 2 extending into the mailbox interior 24, by inserting the right side wall 25 of the mailbox 22 between the attachment clip 5 and the outside surface of the right side panel 4. Accordingly, the reflection surface 10 faces the mailbox interior 24. After opening the mailbox door 23, a user (not shown) slides the switch 75 in the switch slot 76, causing contact of the contact extension 41 of the pivot contact 36 with the clip contact 16 and illuminating the light bulb 20, as heretofore described with respect to FIG. 4. The mailbox interior 24 is therefore sufficiently illuminated to enable the user to view the contents of the mailbox interior 24. It will be appreciated from a consideration of FIG. 4 that the beveled or concave reflection surface 10, in combination with the panel bevel 3*a* and panel extensions 3*b*, reflects or scatters the light from the light bulb 20 to illuminate substantially the entire mailbox interior 24. After removing the mailbox contents from the mailbox interior 24, the user then slides the switch 75 in the opposite direction in the switch slot 76, causing the contact extension 41 of the pivot contact 36 out of contact with the clip contact 16 and extinguishing the light bulb 20, as heretofore described with respect to FIG. 3. It will be appreciated by those skilled in the art that the multi-purpose light 1 can be attached to the interior of a variety of enclosures including a purse (not illustrated), for example, for selective illumination of the interior of the enclosure by manipulation of the switch 75, depending on the desires of the user.

Figure 9:
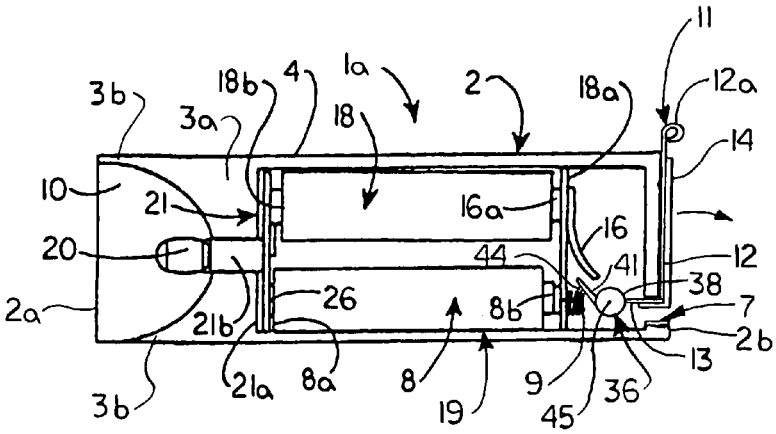
FIG. 9 is an interior view of the right housing panel element of the multi-purpose light, with a preferred battery assembly for energizing the light bulb element, and the activation clip element shown breaking electrical contact between the batteries of the battery assembly to extinguish the light bulb.
Figure 10:
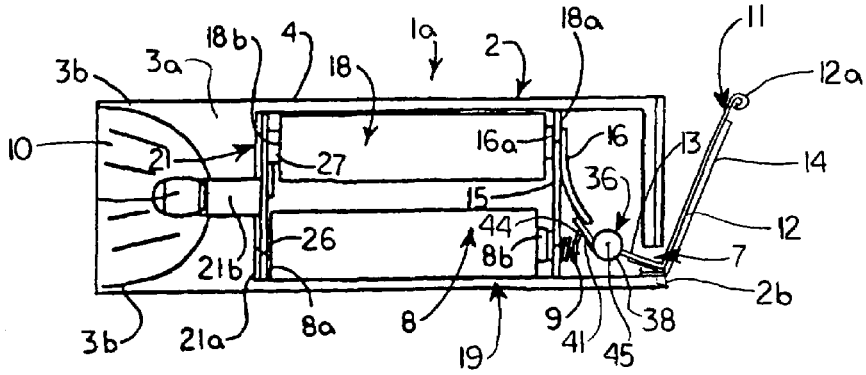
FIG. 10 is an interior view of the right housing panel element of the multi-purpose light, with the extended, spring-loaded activation clip element of the light shown establishing electrical contact between the batteries to energize the light bulb.

Referring next to FIGS. 7–10 of the drawings, an alternative embodiment of the multi-purpose light of the present invention is generally indicated by reference numeral 1*a*. The multi-purpose light 1*a* includes an activation clip 11 which is attached to the pivot portion 38 of the pivot contact 36, as illustrated in FIGS. 9 and 10. The activation clip 11, which is constructed of an electrically-conductive metal, includes a long segment 12, the extending end of which typically terminates in a loop 12*a*. An angled short segment 13 extends from the other end of the long segment 12. The extending end of the short segment 13 is inserted in the attachment slot 42 (FIG. 5) of the pivot contact 36 and secured therein according to the knowledge of those skilled in the art. An L-shaped, typically plastic sheath 14 is bonded or otherwise attached to the outside surfaces of the long segment 12 and short segment 13, respectively, of the activation clip 11. The short segment 13 of the activation clip 11 extends through a left panel clip notch (not illustrated) and an aligned right panel clip notch 7, provided in the front housing panel 3 and attached rear housing panel 4, respectively, of the housing 2 at the rear end 2*b* thereof. The contact spring 9 is attached to the spring attachment tab 44 of the pivot contact 36. Accordingly, as illustrated in FIG. 9, the activation clip 11 can be pressed against the housing 2 with the long segment 12 thereof seated in a clip depression 11*a* (FIG. 8) provided in the front end 2*a* of the housing 2, wherein the pivot contact 36 is disposed in such a position that the contact extension 41 disengages the clip contact 16, thereby breaking electrical contact between the positive terminal 8*b* of the first battery 8 and the negative terminal 18*a* of the second battery 18 and extinguishing the light bulb 20. As illustrated in FIG. 10, upon release, the pivot portion 38 of the pivot contact 36 rotates in the clockwise direction on the pivot pin 45 and the activation clip 11 extends from the clip depression 11*a* by operation of the contact spring 9. The contact extension 41 of the pivot contact 36 contacts the clip contact 16, thereby establishing electrical contact between the positive terminal 8*b* of the first battery 8 and the negative terminal 18*a* of the second battery 18 and energizing the light bulb 20.

Figure 13:
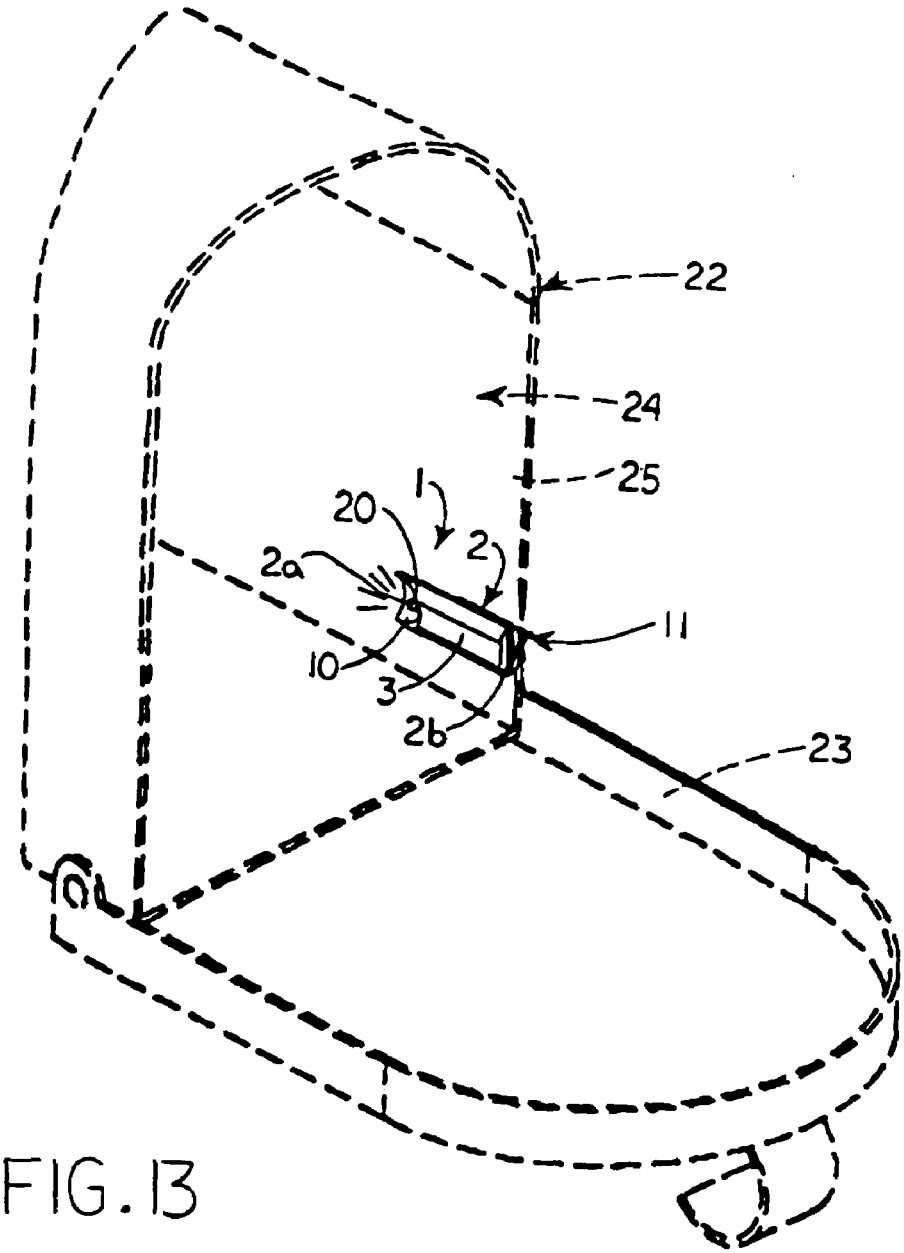
FIG. 13 is a perspective view of a preferred embodiment of the activation clip-operated embodiment of the multi-purpose light of the present invention, removably attached to a post-type mailbox (in phantom) and illuminating the mailbox interior upon opening of the mailbox door.

Referring next to FIGS. 9, 10 and 13 of the drawings, in one possible application the multi-purpose light 1*a* is attached to the right side wall 25 of a post-type mailbox 22 with the housing 2 extending into the mailbox interior 24, by inserting the right side wall 25 of the mailbox 22 between the attachment clip 5 and the outside surface of the right side panel 4, as illustrated in FIG. 4. Accordingly, the reflection surface 10 faces the mailbox interior 24. When the mailbox door 23 of the mailbox 22 is in the closed position, the mailbox door 23 presses the activation clip 11 against the rear end 2*b* of the housing 2, with the long segment 12 of the activation clip 11 seated in the clip depression 11*a* (FIG. 8) of the housing 2. The contact extension 41 of the pivot contact 36 is spaced from the clip contact 16, breaking electrical contact between the first battery 8 and second battery 18. Upon opening of the mailbox door 23 as illustrated in FIG. 13, the spring-biased activation clip 11 is released, whereupon the activation clip 11 pivots outwardly from the clip depression 11*a* of the housing 2 as the contact spring 9 rotates the pivot portion 38 of the pivot contact 36 in the clockwise direction on the pivot pin 45 and the contact extension 41 of the pivot contact 36 contacts the clip contact 16. The pivot contact 36 therefore establishes electrical contact between the positive terminal 8*b* of the first battery 8 and the negative terminal 18*a* of the second battery 18 to energize the light bulb 20. Upon closing of the mailbox door 23, the mailbox door 23 pushes against the activation clip 11 at the loop 12*a* of the long segment 12 thereof to seat the long segment 12 in the clip depression 11*a* of the housing 2. Accordingly, as heretofore described with respect to FIG. 9, the pivot portion 38 of the pivot contact 36 rotates in the counterclockwise direction on the pivot pin 45 such that the contact extension 41 disengages the clip contact 16, against the bias of the contact spring 9 exerted against the contact extension 41, to break electrical contact between the first battery 8 and the second battery 18 and extinguish the light bulb 20. It will be appreciated that the loop 12*a* end of the long segment 12 of the activation clip 11 can be bended beyond the plastic sheath 14 to enhance the contact capability of the activation clip 11 with the mailbox door 23, as needed in the event that the activation clip 11 partially loses its shape after repeated use. It will be further appreciated by those skilled in the art that the multi-purpose light 1*a* can be attached to the interior of a variety of enclosures including a purse (not illustrated), for example, for automatic illumination of the interior of the enclosure by release of the activation clip 11.

Referring again to FIGS. 3, 4, 9 and 10 of the drawings, it is understood that the multi-purpose light 1 and 1*a* of the present invention can be constructed using light bulbs 20 of any suitable type, including those capable of being energized using one battery. In that case, the first battery 8 is provided in electrical contact with the light bulb 20 through the negative contact 26 (FIG. 9) of the bulb harness 21, and in electrical contact with the pivot contact 36 through the contact spring 9, as heretofore described, except the second battery 18 is omitted from the battery assembly 19 and the clip contact 16 is provided in direct electrical contact with the light bulb 20, through the positive contact 27 (FIG. 9) of the bulb harness 21.

While the preferred embodiments of the invention have been described above, it will be recognized and understood that various modifications can be made in the invention and the appended claims are intended to cover all such modifications which may fall within the spirit and scope of the invention.

What is claimed is:

1. A multi-purpose light comprising:

a housing;

an illumination mechanism provided in said housing for illuminating the mailbox interior;

a switch provided on said housing for reversibly activating said illumination mechanism; and a pivot contact having a generally cylindrical pivot portion rotatably mounted in said housing and engaged by said switch and a contact extension extending from said pivot portion, said switch moveable between a first position wherein said contact extension disengages said illumination mechanism and said illumination mechanism is extinguished, and a second position wherein said pivot contact rotates in said housing and said contact extension engages said illumination mechanism and said illumination mechanism is activated.

2. The multi-purpose light of claim 1 comprising a reflective surface provided on said housing for reflecting light from said illumination mechanism.

3. The multi-purpose light of claim 1 wherein said pivot contact comprises a plastic pivot contact body and an electrically-conductive coating provided on said pivot contact body.

4. The multi-purpose light of claim 3 comprising a reflective surface provided on said housing for reflecting light from said illumination mechanism.

5. The multi-purpose light of claim 1 further comprising a flexible switch connector connecting said switch and said pivot portion of said pivot contact.

6. The multi-purpose light of claim 5 comprising a reflective surface provided on said housing for reflecting light from said illumination mechanism.

7. The multi-purpose light of claim 5 wherein said pivot contact comprises a plastic pivot contact body and an electrically-conductive coating provided on said pivot contact body.

8. The multi-purpose light of claim 7 comprising a reflective surface provided on said housing for reflecting light from said illumination mechanism.

9. A multi-purpose light comprising:

a housing;

an attachment clip provided on said housing for removably attaching said housing to the mailbox;

a light bulb extending from said housing;

a battery provided in said housing and in electrical contact with said light bulb;

a contact spring provided in electrical contact with said light bulb;

a switch provided on said housing for reversibly activating said light bulb; and a pivot contact having a generally cylindrical pivot portion rotatably mounted in said housing and engaged by said switch, a contact extension extending from said pivot portion and a spring attachment tab extending from said contact extension and engaged by said contact spring, said switch moveable between a first position wherein said contact extension disengages said battery and said light bulb is extinguished, and a second position wherein said pivot contact rotates in said housing and said contact extension engages said battery and said light bulb is activated.

10. The multi-purpose light of claim 9 comprising an angled reflective surface provided on said housing adjacent to said light bulb for reflecting light from said light bulb.

11. The multi-purpose light of claim 9 wherein said pivot contact comprises a plastic pivot contact body and an electrically-conductive coating provided on said pivot contact body.

12. The multi-purpose light of claim 11 comprising an angled reflective surface provided on said housing adjacent to said light bulb for reflecting light from said light bulb.

13. The multi-purpose light of claim 9 further comprising a flexible switch connector connecting said switch and said pivot portion of said pivot contact.

14. The multi-purpose light of claim 13 comprising an angled reflective surface provided on said housing adjacent to said light bulb for reflecting light from said light bulb.

15. The multi-purpose light of claim 13 wherein said pivot contact comprises a plastic pivot contact body and an electrically-conductive coating provided on said pivot contact body.

16. The multi-purpose light of claim 15 comprising an angled reflective surface provided on said housing adjacent to said light bulb for reflecting light from said light bulb.

17. A multi-purpose light comprising:

a housing;

an illumination mechanism provided in said housing for illuminating the mailbox interior;

an activation clip carried by said housing for reversibly activating said illumination mechanism; and a pivot contact having a generally cylindrical pivot portion rotatably mounted in said housing and engaged by said activation clip and a contact extension extending from said pivot portion, said activation clip moveable between a first position wherein said contact extension disengages said illumination mechanism and said illumination mechanism is extinguished, and a second position wherein said pivot contact rotates in said housing and said contact extension engages said illumination mechanism and said illumination mechanism is activated.

18. The multi-purpose light of claim 17 wherein said pivot contact comprises a plastic pivot contact body and an electrically-conductive coating provided on said pivot contact body.

19. The multi-purpose light of claim 17 wherein said activation clip comprises a long segment extending from said housing and a short segment extending from said long segment and engaging said pivot portion of said pivot contact.

20. The multi-purpose light of claim 19 wherein said pivot contact comprises a plastic pivot contact body and an electrically-conductive coating provided on said pivot contact body.

* * * * *